US009016725B2

(12) United States Patent
Parker et al.

(10) Patent No.: US 9,016,725 B2
(45) Date of Patent: Apr. 28, 2015

(54) PUBLICATION AND METHOD OF MAKING A PUBLICATION

(76) Inventors: John Thomas Parker, Lansing, NY (US); Steve Carver, Ithaca, NY (US)

( * ) Notice: Subject to any disclaimer, the term of this patent is extended or adjusted under 35 U.S.C. 154(b) by 187 days.

(21) Appl. No.: 13/542,058

(22) Filed: Jul. 5, 2012

(65) Prior Publication Data

US 2013/0015649 A1 Jan. 17, 2013

Related U.S. Application Data

(60) Provisional application No. 61/506,230, filed on Jul. 11, 2011.

(51) Int. Cl.

| | |
|---|---|
| ***B42D 5/00*** | (2006.01) |
| ***B42C 3/00*** | (2006.01) |
| ***A63F 9/10*** | (2006.01) |
| ***A63H 33/38*** | (2006.01) |
| *B42D 1/00* | (2006.01) |
| *B42D 1/10* | (2006.01) |
| *A63F 9/06* | (2006.01) |

(52) U.S. Cl.

CPC . *B42D 5/00* (2013.01); *B42D 1/004* (2013.01); *B42D 1/001* (2013.01); *B42D 1/10* (2013.01); *B42C 3/00* (2013.01); *B42D 1/006* (2013.01); *B42D 1/009* (2013.01); *B42D 5/002* (2013.01); *A63F 9/10* (2013.01); *A63F 2009/0688* (2013.01); *A63F 2250/282* (2013.01); *A63H 33/38* (2013.01)

(58) Field of Classification Search

CPC ..... B42D 1/00; G09B 1/00
USPC ..... 281/15.1, 22, 27, 51; 211/45
See application file for complete search history.

(56) References Cited

U.S. PATENT DOCUMENTS

| | | | | |
|---|---|---|---|---|
| 2,230,634 | A * | 2/1941 | Williams | 281/26 |
| 2,296,797 | A * | 9/1942 | Petersen | 281/16 |
| 3,210,093 | A * | 10/1965 | Steidinger | 281/21.1 |
| 3,476,307 | A * | 11/1969 | Faltin et al. | 229/69 |
| 4,842,303 | A * | 6/1989 | Molenda | 281/38 |
| 4,884,826 | A * | 12/1989 | Slagsvol | 281/2 |
| 5,979,090 | A * | 11/1999 | Lee et al. | 40/119 |
| 6,361,045 | B1 * | 3/2002 | Bernstein | 273/157 R |
| 7,037,564 | B1 * | 5/2006 | Abron | 428/40.1 |
| 2003/0151245 | A1 * | 8/2003 | Levine et al. | 283/56 |
| 2006/0019050 | A1 * | 1/2006 | Gilmer | 428/40.1 |
| 2008/0073898 | A1 * | 3/2008 | Lee | 281/15.1 |

* cited by examiner

*Primary Examiner* — Shelley Self
*Assistant Examiner* — Homer Boyer
(74) *Attorney, Agent, or Firm* — Brown & Michaels, PC

(57) ABSTRACT

A publication including a plurality of pairs of pages, with the pair of pages comprised of a removable page and non-removable page. The removable page has a perforated edge, an adhesive edge opposite the perforated edge and a printable surface. The non-removable page has a printable surface. The pairs of pages are arranged such that alternate pages are removable and can be removed without harming the publication or the non-removable pages. The removable pages can be arranged to form an image larger than the publication itself and removable attached to a surface through the adhesive edge.

9 Claims, 1 Drawing Sheet

PUBLICATION AND METHOD OF MAKING A PUBLICATION

REFERENCE TO RELATED APPLICATIONS

This application claims one or more inventions which were disclosed in Provisional Application No. 61/506,230 filed Jul. 11, 2011, entitled "PUBLICATION AND METHOD OF MAKING A PUBLICATION". The benefit under 35 USC §119(e) of the United States provisional application is hereby claimed, and the aforementioned application is hereby incorporated herein by reference.

BACKGROUND OF THE INVENTION

Field of the Invention

The invention pertains to the field of publication. More particularly, the invention pertains to publication and a method of making a publication.

SUMMARY OF THE INVENTION

A publication including a plurality of pairs of pages, with the pair of pages comprised of a removable page and non-removable page. The removable page has a perforated edge, an adhesive edge opposite the perforated edge and a printable surface. The non-removable page has a printable surface. The pairs of pages are arranged such that alternate pages are removable and can be removed without harming the publication or the non-removable pages. The removable pages can be arranged to form an image larger than the publication itself and removably attached to a surface through the adhesive edge.

DETAILED DESCRIPTION OF THE INVENTION

Figure 1:
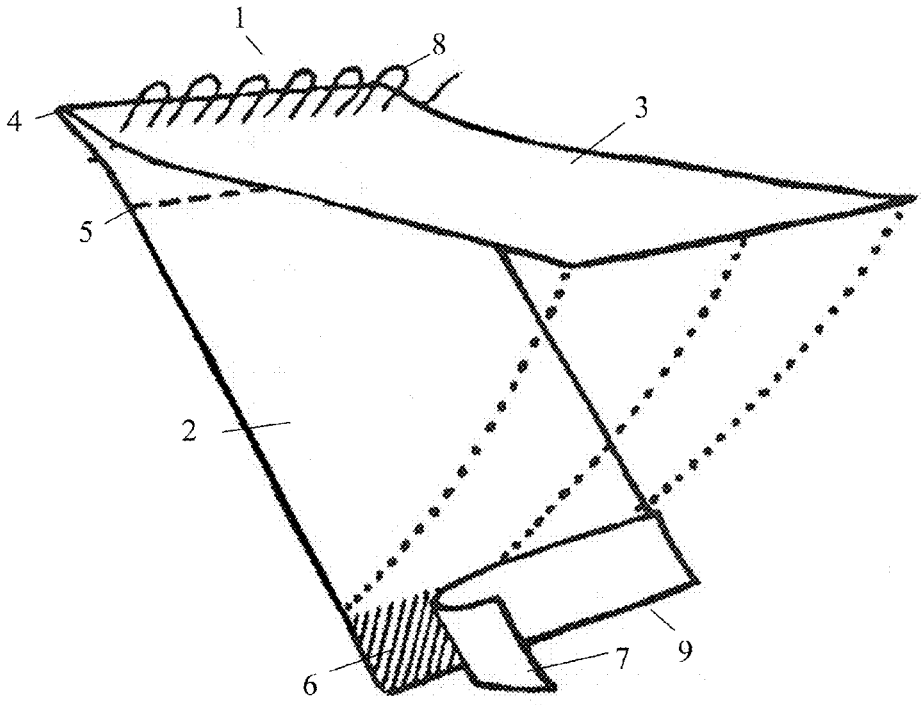
FIG. 1 shows a drawing of a pair of pages according to the invention.

The invention provides a novel method of folding, perforating, and binding a publication (such as a book) so that the pages are manufactured as pairs 1 of two fully printable surfaces 2 and 3, one page 2 of which bears an adhesive edge 6 and can be removed from the publication without damaging the remaining page or rendering the original publication (such as a book) useless. The invention also provides a publication (such as a book) made of multiple pages, every other page of which (that is, alternate pages) can be removed from the publication by means of a perforation 5.

FIG. 1 shows an example of a pair 1 of pages according to the invention. The removable page 2 of each pair 1 will have an area of adhesive 6, initially protected by a peel-off cover strip 7. The page 2 is perforated 5 to allow removal from the publication. When removed, the page 2 can be fastened to a planar surface (such as a wall) with the adhesive 6, which is preferably a removable adhesive such as is used on Post-It® products from 3M.

The pair 1 of pages is preferably formed of one sheet of paper, which is folded along line 4 to form pages 2 and 3. When folded during manufacture, the unperforated page 3 of the two-page pair 1, will extend the same distance from the fold 4 as the perforated page 2, minus the width of the adhesive surface 6 with cover tape 7 on the adjoining perforated page 2, thereby providing a thickness "shim" that accommodates the additional thickness caused by the adhesive cover strip 7. This shim prevents one end 9 of the folded pair 1 (that is, the end with the adhesive cover strip 7) from being thicker than the other (the end with fold 4).

This allows for a bound assemblage of multiple pairs of this publication to stack in such a way that the stack will be of the same thickness on all sides (as opposed to "wedge shaped" if constructed with a peel-off adhesive cover strip 7 on one end, but not the other.)

Using binding techniques known to the art, such as sewing 8, gluing, stapling, etc., with the folding, perforating, taping arrangement described here, multiples of these folded pairs 1 can be combined to form a publication (such as a book) that allows for removal of alternate pages 2 (by means of the aforementioned perforation 5) while leaving a like number of pages 3 remaining in the original book (thereby preserving its functionality.)

Once the perforated pages 2 are removed from the bound publication, additional free space is created between the remaining pages 3 in the bound publication, which makes certain functions, such as flip-animation, easier to perform and more visually effective.

Figure 2:
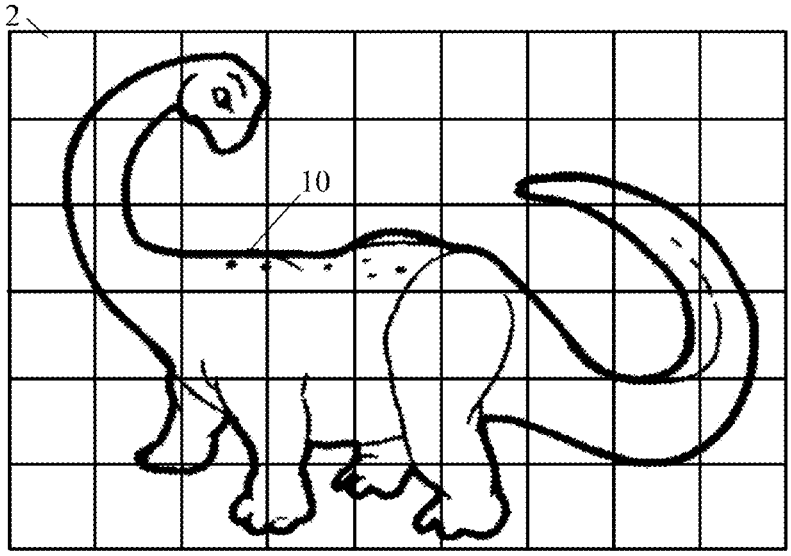
FIG. 2 shows an example of a tiled image made from the removable pages of the publication of the invention.

The invention also presents a publication in which the removable pages 2 can be combined to create an image on a surface which is much larger than the book itself. FIG. 2 shows how this can be accomplished. The removable pages 2 are removed from a publication and the adhesive cover strips 7 are removed. The pages 2 are then adhered by adhesive area 6 to a surface such as a wall in a tiled array. Together, the combination of the pages form a combined image 10 or poster, calendar, billboard etc. Thus, as an example, a publication describing, say a dinosaur, can be created in which one can detach alternate pages and combine them to create a life-sized dinosaur on a wall. The removable pages can be provided with sequential numbers or row/column indications to facilitate proper assembly, or the tiles could form parts of a jigsaw-like assembly, leaving it up to the user to determine how they should be arranged.

Therefore, the present invention provides for a publication (such as a book) that has removable pages bearing adhesive. The present invention also provides for removal of a portion of the publication (such as a book) while preserving the remaining portion. The present invention provides a means of delivering a publication (such as a book) that can serve dual purposes, each of which can be distinct (such as a book with a large removable tiled poster, calendar, puzzle, billboard) or complimentary (such as a removable component that corresponds to the text or flip animation in the remaining book). The present invention also provides a means for enhancing the flip animation functionality of the publication by allowing for removal of alternate pages, thereby making the physical manipulation of the pages both easier and more effective.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A publication comprising:

a plurality of pairs of pages comprising:

a removable page having: a perforated edge, an adhesive on an adhesive surface of the removable page for adhering the removable page to a surface, the adhesive surface being opposite the perforated edge, and a printable surface;

a peel-off cover strip covering the adhesive surface; and a non-removable, unperforated page having a printable surface;

wherein the plurality of pairs of pages are stacked within the publication such that alternate pages are the removable pages; and wherein the non-removable, unperforated pages are narrower than the removable pages such that the peel-off cover strips are located beyond an end of the non-removable, unperforated pages.

2. The publication of claim 1, wherein each pair of pages is formed by one sheet of folded paper.

3. The publication of claim 1, wherein the plurality of pairs of pages are bound together by sewing, gluing or stapling.

4. The publication of claim 1, wherein when the removable pages are removed, the non-removable unperforated pages remain intact and undamaged.

5. The publication of claim 1, wherein the printable surface of the removable page bears a partial image, such that when a plurality of the removable pages are placed together, the partial images create an image greater in size than the publication.

6. The publication of claim 1, wherein the adhesive is a removable adhesive.

7. The publication of claim 1, wherein the non-removable, unperforated pages provide a flip animation after the removable pages have been removed from the publication.

8. The publication of claim 1, wherein the non-removable, unperforated pages have a width equal to a width of the removable pages minus a width of the peel-off cover strips.

9. The publication of claim 1, wherein the non-removable, unperforated pages, being narrower than the removable pages, provide a shim to accommodate a thickness of the peel-off cover strips such that the non-removable, unperforated pages and the removable pages form a stack with a same thickness on all sides of the stack.

* * * * *